US010405703B2

(12) United States Patent
Arnold et al.

(10) Patent No.: US 10,405,703 B2
(45) Date of Patent: Sep. 10, 2019

(54) PORTABLE SHOWER ENCLOSURE

(71) Applicants: Larry Arnold, San Leandro, CA (US); Rosemary Bishop Arnold, San Leandro, CA (US)

(72) Inventors: Larry Arnold, San Leandro, CA (US); Rosemary Bishop Arnold, San Leandro, CA (US)

(73) Assignee: Larry Arnold, San Leandro, CA (US)

( * ) Notice: Subject to any disclaimer, the term of this patent is extended or adjusted under 35 U.S.C. 154(b) by 0 days.

(21) Appl. No.: 15/676,500

(22) Filed: Aug. 14, 2017

(65) Prior Publication Data

US 2019/0045981 A1 Feb. 14, 2019

(51) Int. Cl.

| | |
|---|---|
| ***A47K 3/32*** | (2006.01) |
| ***E03C 1/01*** | (2006.01) |
| ***A47K 17/00*** | (2006.01) |
| ***E03C 1/04*** | (2006.01) |
| ***A47K 3/022*** | (2006.01) |
| ***A47K 3/28*** | (2006.01) |

(Continued)

(52) U.S. Cl.

CPC ..... *A47K 3/325* (2013.01); *A47K 3/022* (2013.01); *A47K 3/282* (2013.01); *A47K 13/005* (2013.01); *A47K 17/00* (2013.01); *A47K 17/02* (2013.01); *E03C 1/01* (2013.01); *E03C 1/0409* (2013.01); *A47K 3/38* (2013.01); *A47K 13/04* (2013.01); *A47K 13/14* (2013.01); *E03C 2001/0415* (2013.01)

(58) Field of Classification Search

CPC ..... A47K 11/04; A47K 3/06; A47K 3/325; A47K 3/32; A47K 4/00; A47K 3/282; A47K 11/00; A47K 17/02; A47K 13/005; E03C 1/01

USPC ..... 4/476, 478

See application file for complete search history.

(56) References Cited

U.S. PATENT DOCUMENTS 2,418,915 A * 4/1947 Volk ..... A47K 3/283 4/597

2,699,139 A * 1/1955 Mackey ..... A47K 13/06 116/67 R (Continued)

FOREIGN PATENT DOCUMENTS

CA 2431729 A1 12/2004

OTHER PUBLICATIONS

Website, "FAWSsit Showers," http://www.cgsp.net/products.html (3 pages) Aug. 22, 2017.

(Continued)

*Primary Examiner* — Janie M Loeppke

(74) *Attorney, Agent, or Firm* — Dorsey & Whitney LLP

(57) ABSTRACT

A portable shower enclosure includes a base frame composed of a rear frame, a first lateral frame pivotably coupled to a first lateral side of the rear frame, and a second lateral frame pivotably coupled to second lateral side of the rear frame. A seat with a top surface opposite a bottom surface defines a drain aperture therethrough. One or more bumpers extend from the bottom surface of the seat and are configured to elevate the seat above a rim of a toilet bowl. A waterproof liner defines an aperture therein sized and configured to be positioned over the toilet bowl under the seat. The liner has a frame coupling assembly configured to adjustably couple the liner to the first lateral frame, the second lateral frame, and the rear frame.

21 Claims, 17 Drawing Sheets

(51) Int. Cl.

| | |
|---|---|
| ***A47K 13/00*** | (2006.01) |
| ***A47K 17/02*** | (2006.01) |
| *A47K 3/38* | (2006.01) |
| *A47K 13/04* | (2006.01) |
| *A47K 13/14* | (2006.01) |

(56) References Cited

U.S. PATENT DOCUMENTS

| | | | | |
|---|---|---|---|---|
| 3,096,067 | A * | 7/1963 | O'Connell | A47C 9/06 108/115 |
| D221,771 | S | 9/1971 | Le Blanc et al. | |
| 4,112,524 | A | 9/1978 | Johansson et al. | |
| 4,453,280 | A | 6/1984 | Greenleaf et al. | |
| 4,713,850 | A * | 12/1987 | Flaherty | A47K 3/06 4/585 |
| 5,920,927 | A | 7/1999 | Thomas et al. | |
| 6,185,759 | B1 | 2/2001 | Staudenmayer et al. | |
| 6,378,142 | B1 | 4/2002 | Gray et al. | |
| 6,516,477 | B1 * | 2/2003 | Storm | A47K 3/006 4/555 |
| 7,231,673 | B1 | 6/2007 | Arnold et al. | |
| 2014/0250587 | A1 | 9/2014 | Alsaffar et al. | |

OTHER PUBLICATIONS

Website, "Safety Shower for the Elderly—Sit & Shower," http://www.sitnshower.com/ (6 pages) Aug. 22, 2017.

* cited by examiner

PORTABLE SHOWER ENCLOSURE

TECHNICAL FIELD

This disclosure relates generally to shower enclosures and more specifically to methods and apparatus for a portable shower enclosure.

BACKGROUND

Disabled, injured, or elderly persons may have a difficult time bathing if they are unable to easily access a standard bathroom bath or shower. Sometimes, a bath or shower is in an area of a home that is inaccessible to a person, such as an upper level when the person is unable to navigate the stairs. In some cases, this inaccessibility is because the person is in a wheel chair, or has an injured lower extremity. In other cases, bathing is difficult because a person may be unable to step into a bathtub, or able to stand for a prolonged period of time that would be required for showering. These types of problems may be solved by installing a permanent shower on a floor accessible to the user, but remodeling a home for this need is expensive. Furthermore, the need for a shower on the accessible floor may not be permanent, such that permanent construction is not warranted.

The information included in this Background section of the specification, including any references cited herein and any description or discussion thereof, is included for technical reference purposes only and is not to be regarded subject matter by which the scope of the invention as defined in the claims is to be bound.

SUMMARY

The present disclosure includes embodiments of a portable shower enclosure having a base frame with a shower curtain that surrounds an elevated seat coupled with a waterproof liner configured to an existing toilet bowl. A user may sit on the seat and bathe themselves using a hand held wand with water supplied from an adjacent sink or other water source. The curtain, frame, and liner protect excess water from being sprayed outside of the enclosure, and the used water drains onto the liner and into the toilet bowl.

One embodiment of the present disclosure includes a portable shower enclosure including a base frame, a seat, and a waterproof liner. The base frame may have three vertical sides formed by a rear frame, a first lateral frame that pivotably couples with a first lateral side of the rear frame, and a second lateral frame that pivotably couples with second lateral side of the rear frame. The seat may have a top surface opposite a bottom surface and define a drain aperture therethrough. One or more bumpers may extend from the bottom surface of the seat and may be configured to elevate the seat above a rim of a toilet bowl. The waterproof liner may define an aperture therein sized configured to be positioned over the toilet bowl under the seat. The waterproof liner may have a frame coupling assembly configured to adjustably couple the waterproof liner to the first lateral frame, the second lateral frame, and the rear frame.

Another embodiment of the present disclosure includes a portable shower enclosure kit comprising a base frame, a seat, a waterproof liner, and a waterproof curtain. The base frame may have three vertical sides formed by a rear frame, a first lateral frame that pivotably couples with a first lateral side of the rear frame, and a second lateral frame that pivotably couples with second lateral side of the rear frame. The seat may have a top surface opposite a bottom surface and define a drain aperture therethrough. One or more bumpers may extend from the bottom surface of the seat and may be configured to elevate the seat above a rim of a toilet bowl. The waterproof liner may define an aperture therein sized configured to be positioned over the toilet bowl under the seat and may have a frame coupling assembly configured to adjustably couple the waterproof liner to the first lateral frame, the second lateral frame, and the rear frame. The waterproof curtain may be moveably attached to each of the first lateral frame, the second lateral frame, and the rear frame.

Another embodiment of the present disclosure includes a method of configuring a portable shower enclosure. An existing toilet and water supply may be accessed. An existing toilet seat may be removed from the toilet. A frame may be assembled and installed about the toilet. A seat and liner may be assembled together and installed upon a rim of a toilet bowl of the toilet. The liner may be attached to the frame. A curtain may also be attached to the frame around the toilet.

This Summary is provided to introduce a selection of concepts in a simplified form that are further described below in the Detailed Description. This Summary is not intended to identify key features or essential features of the claimed subject matter, nor it is intended to be used to limit the scope of the claimed subject matter. A more extensive presentation of features, details, utilities, and advantages of the embodiments of the disclosure defined in the claims is provided in the following written description illustrated in the accompanying drawings.

DETAILED DESCRIPTION

This disclosure is related to a shower enclosure that may be used to modify an existing toilet so that it may be used as a drain for a shower. In some examples, a portable, collapsible frame with an attached shower curtain, padded seat, and liner is positioned about an existing toilet base, and a hose assembly connected to a water supply from a sink faucet is used to supply water for bathing, and the water may then drain into the toilet.

Figure 1:
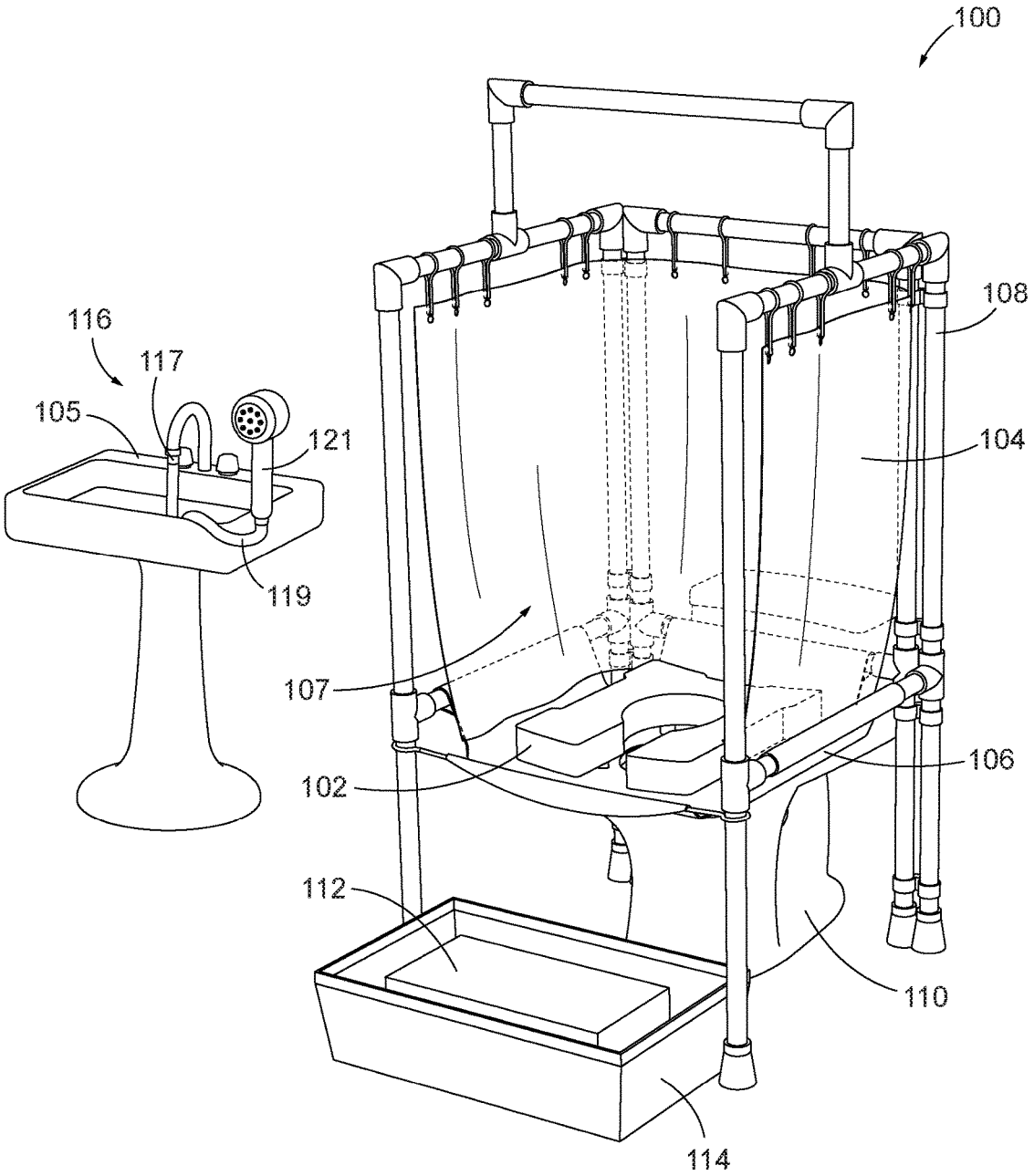
FIG. 1 is an isometric view of a shower assembly.
Figure 2:
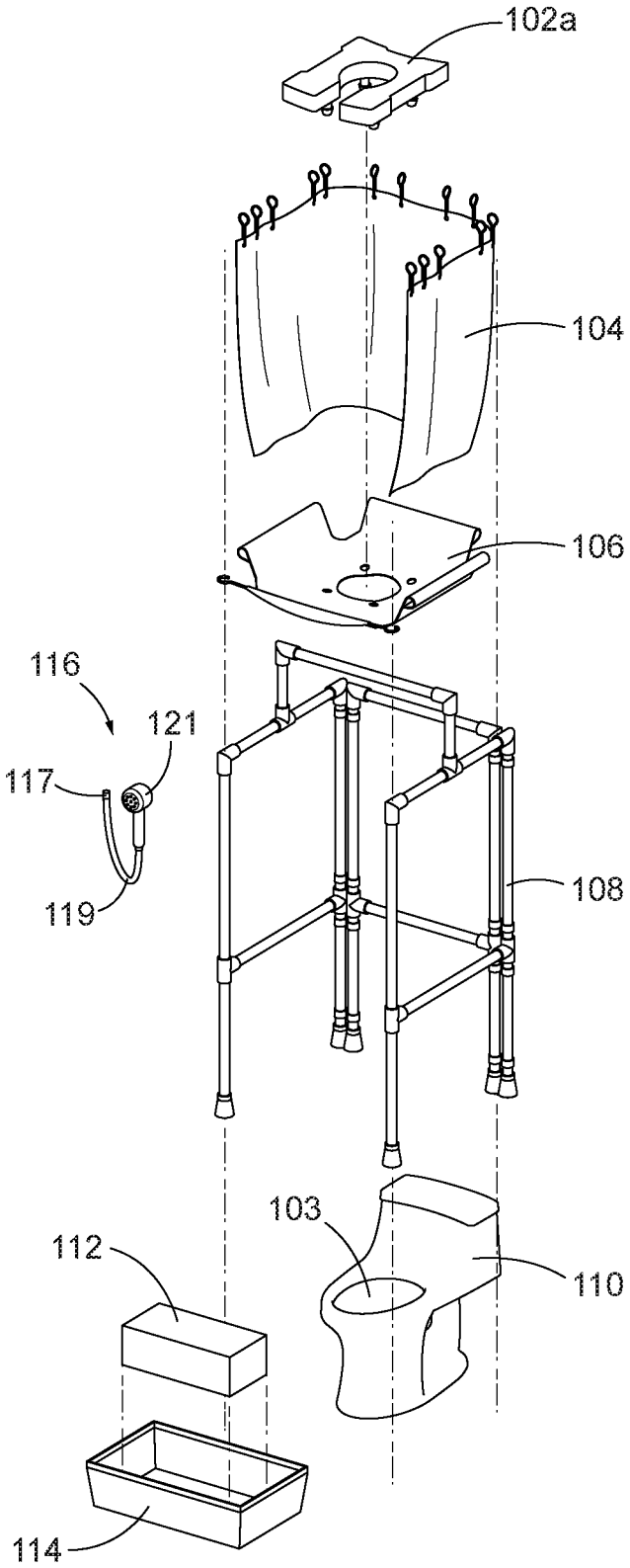
FIG. 2 is an exploded view of the shower assembly of FIG. 1.

FIG. 1 is an isometric view of a shower assembly 100. FIG. 1 shows a home healthcare equipment embodiment of a shower assembly 100, with a seat 102, a frame 108, a liner 106, a curtain 104, a pan 114, a footrest 112, a hose assembly 116; a toilet 110, and a sink 105. The hose assembly 116 may further include a connector 117, a hose 119, and a handheld showerhead 121 or spray wand. FIG. 2 is an exploded view of the shower assembly 100 of FIG. 1. The sink 105 and toilet 110 may be existing components in a user's home, hospital room, hotel room or the like. When assembled for use, the shower assembly 100 may be positioned about the toilet 110 and the hose assembly 116 may be coupled to the sink 105 or other water supply. Portions of the shower assembly 100 may be similar to a commode seat assembly. The seat 102 is coupled to the liner 106 and then positioned to align or couple with the existing toilet 110. The liner 106 and curtain 104 are coupled to the frame 108. The pan 114 may be positioned in front of the toilet 110 and the footrest 112 may be placed within the pan 114.

A user may then engage with the shower assembly 100 by sitting on the seat 102 and resting their feet on the footrest 112 in the pan 114. The water supply may be engaged from the sink 105, and the user may use the water flowing through the hose assembly 116 to bathe while sitting on the seat 102. The user may be partially enclosed within the frame 108 and curtain 104. Water supplied through the hose assembly 116 may then drain into the toilet 110. The pressure of the fluid within the bowl of the toilet 110 will naturally force excess fluid to flow through a toilet trap into a fluidly connected plumbing system. The user does not need to flush or engage a toilet flushing mechanism to force the toilet to drain the fluid being supplied from the water supply, e.g., the sink 105. The curtain 104 may help prevent spray from the wand 121 from contacting surroundings and also provide privacy for the user. The liner 106 coupled to the frame 108 helps protect surroundings from water spray and allows for water that contacts the curtain 104 to drain between the seat 102 and a toilet bowl 103 and flow into the toilet bowl 103. The liner 106 also allows for water that first contacts the user to then drain into the toilet bowl 103.

Figure 3:
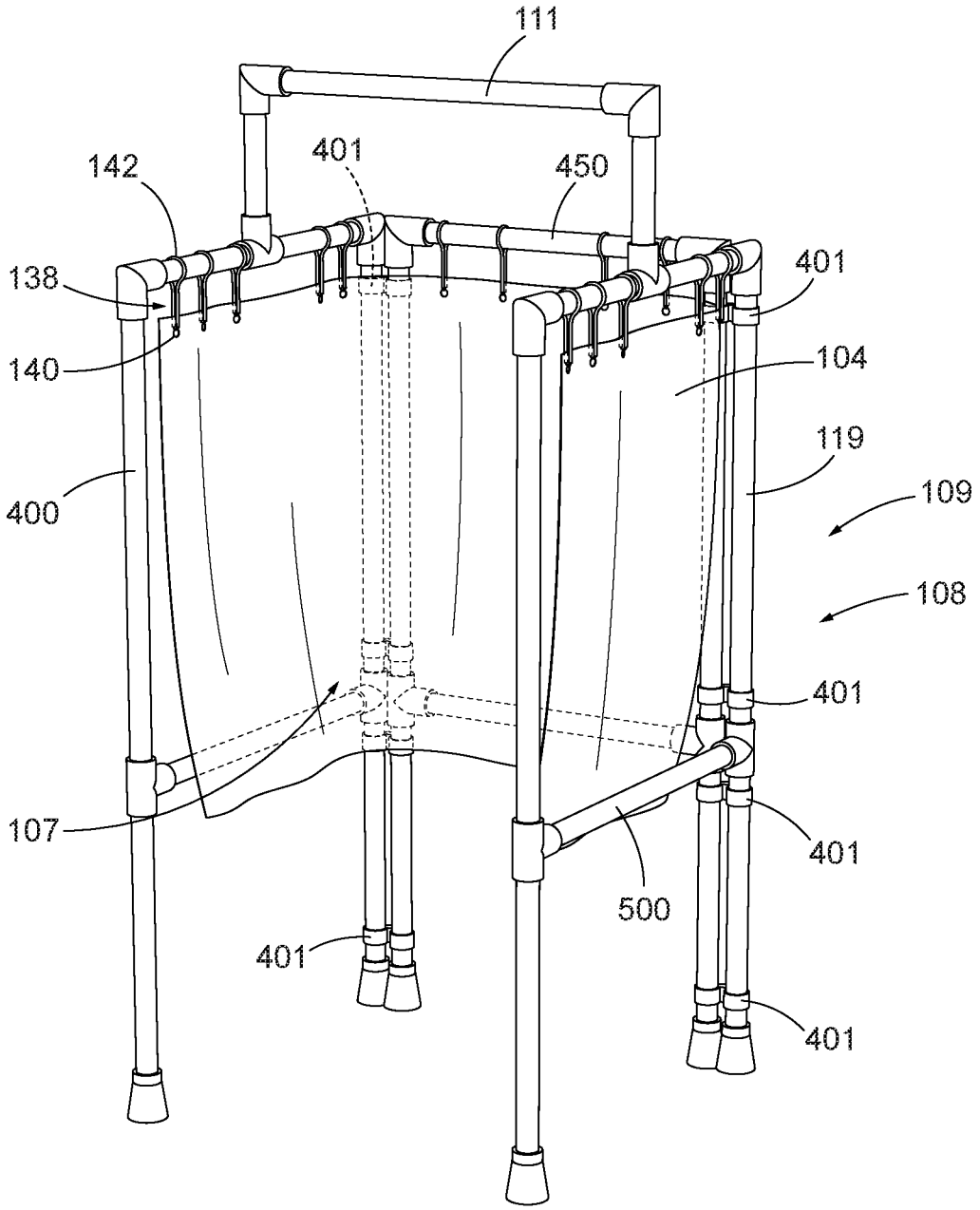
FIG. 3 is an isometric view of a frame and a curtain of the shower assembly of FIG. 1.

FIG. 3 is an isometric view of the frame and curtain of the shower assembly of FIG. 1. In some examples, the frame 108 is composed of a base frame 109 and stabilizer frame 111. The curtain 104 may be coupled to the base frame 109 using a plurality of coupling features 138. In some examples, the coupling features 138 include apertures 140 formed along the top edge of the curtain 104, and a plurality of rings or hooks 142 that couple the curtain 104 with the base frame 109 by extending through the aperture 140. The hooks 142 may be loosely coupled to the base frame 109 such as by partially circumferentially surrounding a portion of the base frame 109, so that the location of the curtain 104 with respect to an overall horizontal perimeter of the base frame 109 may be adjusted.

As shown in FIG. 3, the base frame 109 may be coupled with the curtain 104 so that the base frame 109 and curtain 104 form three walls with an opening 107 at the front of the toilet base 110. The opening 107 may allow a user to access the toilet 110 when the assembly 100 is installed about the toilet 110. The opening 107 may be formed between a first lateral frame assembly 400 and a second lateral frame assembly 500 when the assembly 100 is positioned on the ground and about the toilet base 110.

Figure 4:
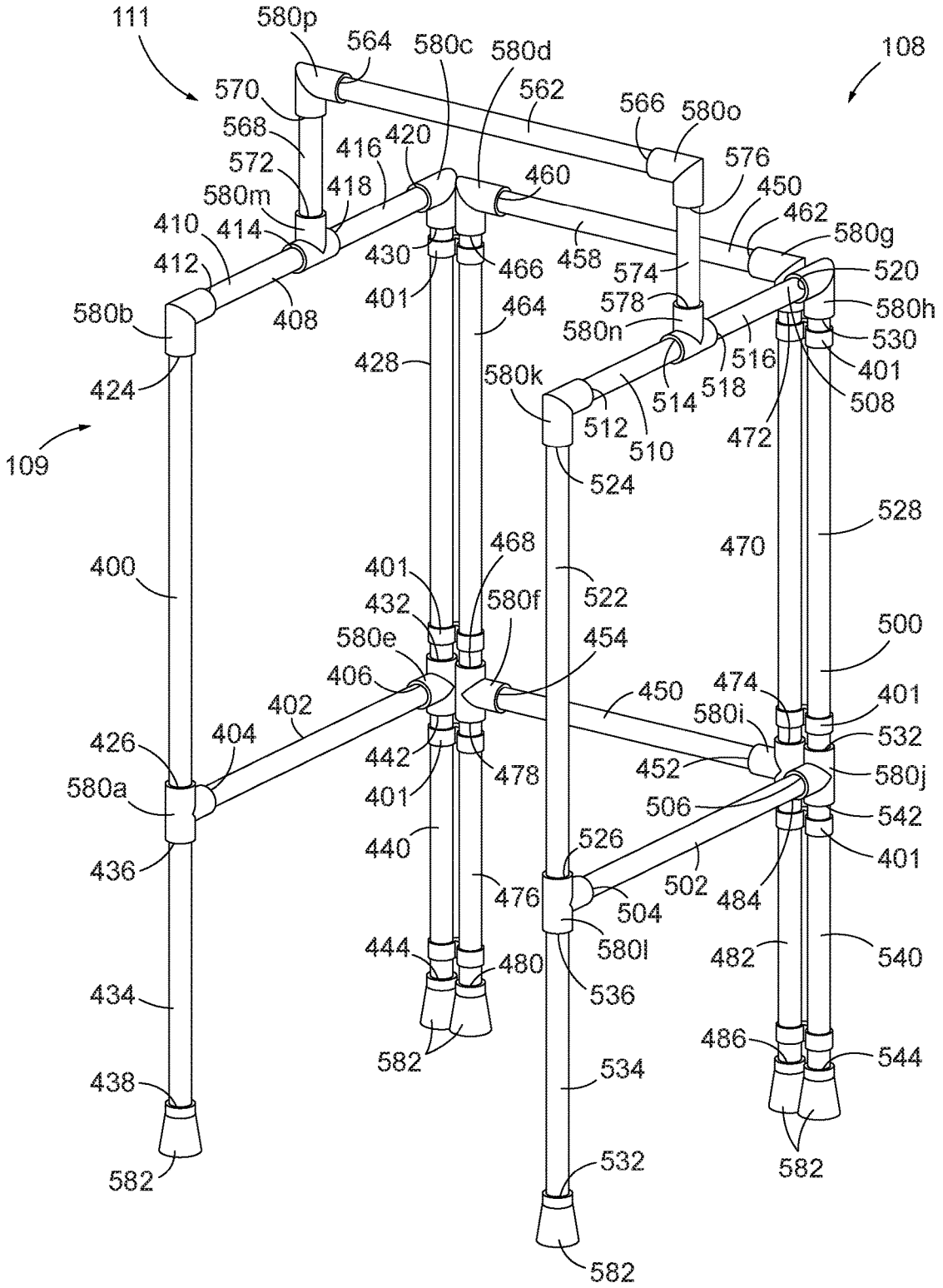
FIG. 4 is an isometric view of the frame of the shower assembly of FIG. 1.

FIG. 4 is an isometric view of the frame 108 of the shower assembly 100 of FIG. 1. The frame 108 may be comprised of different frame portions. The base frame 109 may have framed walls formed by a first lateral frame assembly 400, a rear frame assembly 450, and a second lateral frame assembly 500. The frame assemblies 400, 450, 500 may be similarly constructed with similar materials having the same size and dimensions.

The first lateral frame assembly 400 may have a middle cross member 402, an upper cross member 408, a first upper vertical member 422, a second upper vertical member 428, a first lower vertical member 434, and a second lower vertical member 440. The middle cross member 402 may have a first end 404 and a second end 406. The upper cross member 408 may have a first portion 410 having a first end 412 and a second end 414, and a second portion 416 having a first end 418 and a second end 420. The first upper vertical member 422 may have a first end 424 and a second end 426. The second upper vertical member 428 may have a first end 430 and a second end 432. The first lower vertical member 434 may have a first end 436 and a second end 438. The second lower vertical member 440 may have a first end 442 and a second end 444. Protective elements 582 (e.g., rubber feet) may be coupled to the second ends 438, 444 of the first and second lower vertical members 434, 440in order to resist slipping of the frame 108 on a surface.

The first upper vertical member 422 may be positioned vertically above and inline with the first lower vertical member 434. The second upper vertical member 428 may be positioned vertically above and inline second lower vertical member 440. The first upper and lower vertical members 422, 434 may be generally parallel to the second upper and lower vertical members 428, 440, and normal to a ground surface.

A three-way T-connector 580*a* may couple the second end 426 of the first upper vertical member 422, the first end 404 of the middle cross member 402, and the end 436 of the first lower vertical member 434. An elbow connector 580*b* may couple the first end 424 of first upper vertical member 422 with the first end 412 of the first portion 410 of upper cross member 408. An elbow connector 580*c* may couple the first end 430 of second upper vertical member 428 with the second end 420 of the second portion 416 of the upper cross member 408. An elbow connector 580*e* may couple the second end 432 of second upper vertical member 428 and the first end 442 of the second lower vertical member 440 together with the middle cross member 402 extending perpendicularly from between the vertical members 428, 440.

The first portion 410 and second portion 416 of the upper cross member 408 may be generally inline with each other, and a T-connector 580*m* couples the second end 414 of the first portion 410 with the first end 418 of the second portion 416. The upper cross member 408 may be positioned vertically above and aligned with the middle cross member 402. The middle cross member 402 and upper cross member 408 may be positioned normal to the first upper and lower vertical members 422, 434 and the second upper and lower vertical members 428, 440.

In some examples, the first upper vertical member 422 and the first lower vertical member 434 may be manufactured as a single component. In some examples the second upper vertical member 428 and second lower vertical member 440 may be manufactured as single component. In some examples, the first lateral frame 400 is manufactured as a single component.

The rear frame assembly 450 and second lateral frame assembly 500 have components similar to those of the first lateral frame assembly 400.

The rear frame assembly 450 may have a middle cross member 452 with first and second ends 454, 456; an upper cross member 458 with first and second ends 460, 462; a first upper vertical member 464 with first and second ends 466, 468; a second upper vertical member 470 with first and second ends 472, 474; a first lower vertical member 476 with first and second ends 478, 480; and a second lower vertical member with first and second ends 484, 486. Protective elements 582 may be coupled to the second ends 480, 486.

In some examples, a difference between the rear frame assembly 450 and the first lateral frame assembly 400 is that the upper cross member 458 does not have a first portion and a second portion, each with first ends and second ends. Instead, the upper cross member 458 is a single member with first and second ends 460, 462.

Elbow connector 580*d* may couple first end 460 with first end 466. T-connector 580*f* may couple second end 468, first end 454, and first end 478. Elbow connector 580*g* may couple second end 462 with first end 472. T-connector 580*i* may couple second end 474, second end 456, and first end 484.

The second lateral frame assembly 500 may have a middle cross member 502 with first and second ends, 504, 506; an upper cross member 508 with a first portion 510 with first and seconds ends 512, 514 and a second portion 516 with first and second ends 518, 520; a first upper vertical member 522 with first and second ends 524, 526; a second upper vertical member 528 with first and second ends 530, 532; a first lower vertical member 534 with first and second ends 536, 538; and a second lower vertical member 540 with first and second ends 542, 544. Protective elements 582 may be coupled to the second ends 538, 544.

Elbow connector 580*h* may couple second end 520 and first end 530. Elbow connector 580*k* may couple first end 512 with first end 524. T connector 580*j* may couple second end 532, second end 506, and first end 542. Elbow connector 580*k* may couple first end 524 and second end 512. T-connector 580*l* may couple second ends 526, 504, 536.

With reference to FIGS. 3 and 4, frame coupling members 401 may flexibly or pivotally connect portions of the base frame 109 together. In some examples, the first lateral frame assembly 400 is adjustably coupled to the rear frame assembly 450 using frame coupling members 401, such as positioned near, adjacent to, or between the second lower vertical member 440 and first lower vertical member 476; between connectors 580*e* and 580*f*; between second upper vertical member 428 and first upper vertical member 464; or at multiple of these locations. In some examples, the second lateral frame assembly 500 is adjustably coupled to the rear frame assembly 450 using frame coupling members 401, such between the second lower vertical member 540 and the second lower vertical member 482, connectors 580*i* and 580*j*, or between second upper vertical member 528 and second upper vertical member 470. The adjustable coupling of the first lateral frame 400 to the rear frame 450, and the second lateral frame 500 to the rear frame 450 may allow a user to adjust the position of the frame 108 in a variety of configurations, such as a first embodiment when the shower assembly 100 is being used for a shower (as shown in FIG. 4) or folded and stored (as described further with reference to FIG. 9). The adjustable frame coupling members 401 may be made of fixed or adjustable loops of material with hook and loop features, snaps, or other coupling systems.

The stabilizer frame 111 may be coupled to the base frame 109. The stabilizer frame 111 may have a cross member 562 with first and second ends 464, 466; a first member 568 with first and second ends 568, 570; and a second member 574 with first end and second ends 576, 578. The cross member 562 may be generally parallel with the upper cross members 458. The first and second members 568, 574 may be generally normal to the upper cross member 562 and normal to the upper cross members 408, 508. Elbow connector 580*p* may couple the first end 564 of the upper cross member 562 with the first end 570 of the first member 568. T-connector 580*m* may couple second end 572 of the first member 568, second end 414 of the first portion 410 of the upper cross member 408, and first end 418 of the second portion 416 of the upper cross member 408. Similarly, elbow connector 580*o* may couple the second end 566 if the upper cross member 562 with the first end 576 of the second member 574. T-connector 580*n* may couple the first end 578 of the second member 574, the second end 514 of the first portion 510 of the upper cross member 508, and the first end 518 of the second portion 516 of the upper cross member 508. In some examples, the first member 568, cross member 562, and second member 574 of the stabilizer frame 111 are formed as a single component.

In some examples, the stabilizer 111 is adjustably coupled to the base frame 109. The adjustable coupling may stabilize the frame 108 so that it may remain upright and configured in a first position (shown in FIG. 4) with the first and second lateral frame assemblies 400, 500 positioned substantially normal to the rear frame 450 and without support from a human user and without support from additional equipment or structures. The stabilizer 111 may also be separated from the base frame 109 at the connectors 580*m* and 580*n* so that the base frame 109 may be collapsed or at least partially disassembled for storage, movement, or ease of handling by a user or caregiver (see FIG. 9).

In some examples, the frame 108 may be manufactured from multiple components, such as cylindrically shaped composite, metal, or wood components. In some examples, the frame 108 and connectors 580 are manufactured using polyvinyl chloride (PVC) tubing or piping that may be assembled and disassembled at the various connectors 580. In some examples, the connectors 580 are permanently coupled to the corresponding members and other connectors 580 are adjustably coupled to the corresponding members. Examples sizes of PVC include diameters ranging from about 0.25 to 2 inches. Other hard, durable plastic formulations may also be used, including ABS, acrylic, polypropylene, phenolic resins or amino resins. These materials may generally have good colorability, may be reasonably priced, and may be readily fabricated by a number of manufacturing processes, including injection molding. Other materials such as aluminum or other metal tubing may also or alternatively be used to provide greater strength, with a trade-off in weight of the frame 108.

Figure 5A:
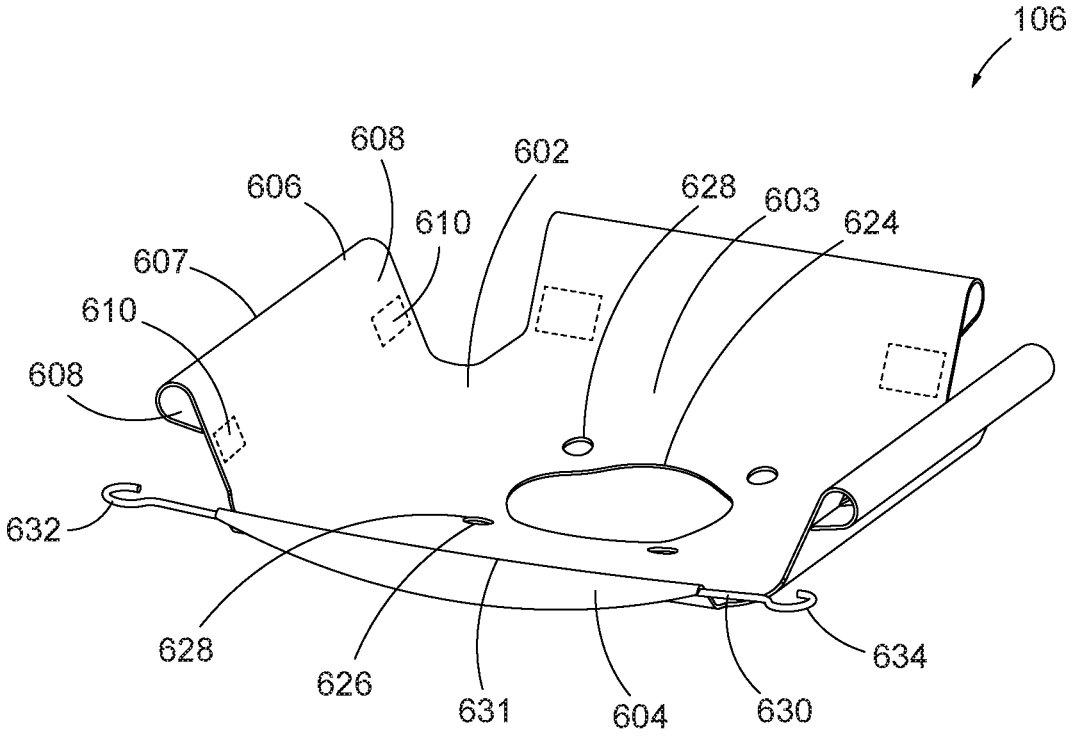
FIGS. 5A-B are top isometric and bottom isometric views of a liner of the shower assembly of FIG. 1.
Figure 5B:
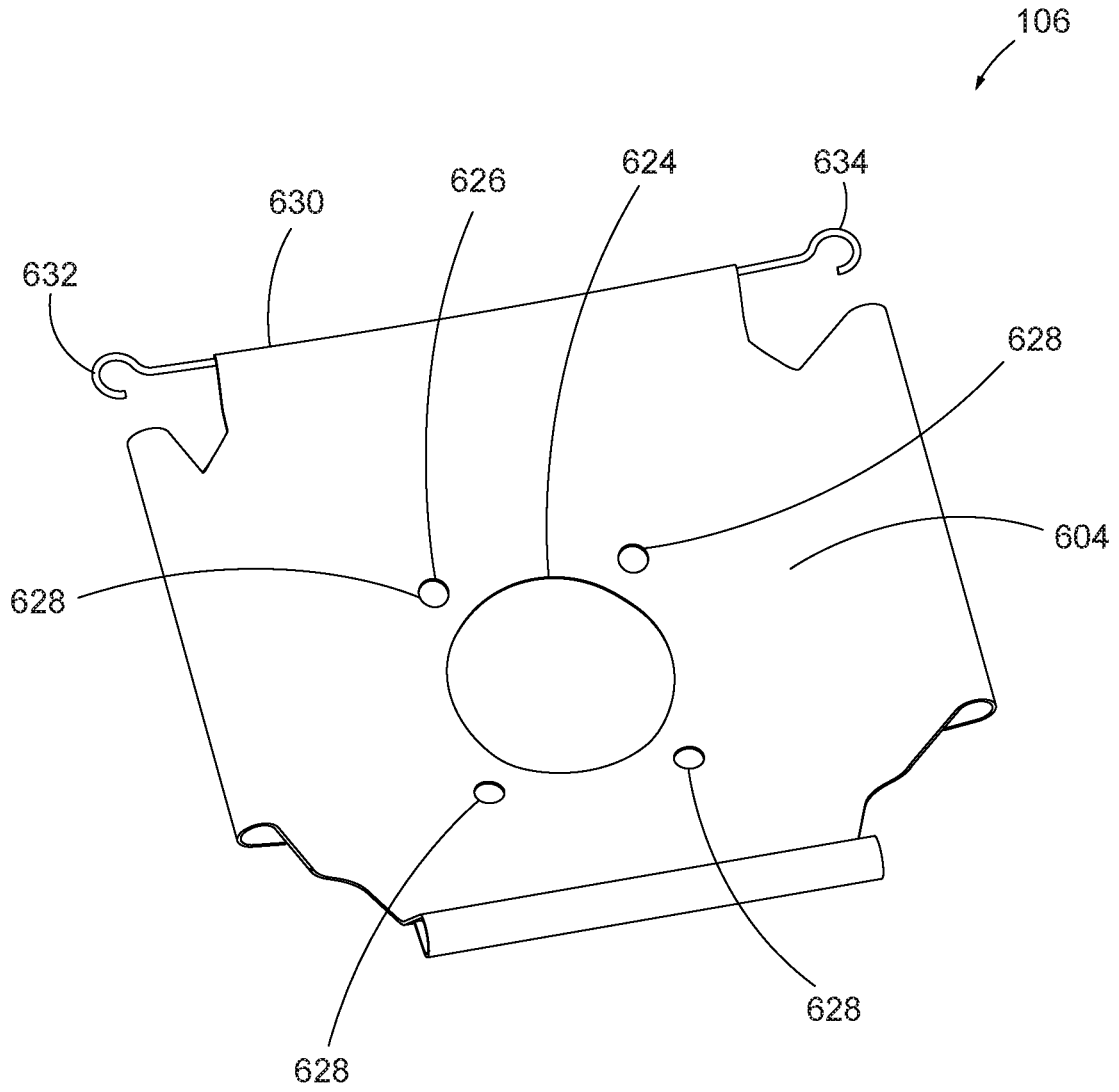

FIGS. 5A-B are top isometric and bottom isometric views of the liner of the shower assembly of FIG. 1. The liner 106 of FIGS. 5A-B may have a first surface 602 opposite a second surface 604 and define a central region 603 with an aperture 624 in the central region 603 extending through the first and second surfaces 602, 604.

A frame coupling assembly 606 may extend from the central region 603. The frame coupling assembly 606 may be configured to couple the liner 106 with the base frame 109. The frame coupling assembly 606 may have at least one tab or flap 608 that extends away from a first lateral edge 607 adjacent to the central region 603, as well as at least one coupling feature 610. In some examples, the coupling feature 610 is a hook and loop type adjustable closure, snaps, buttons, or other similar types of releasable closures. Opposing portions of the coupling feature 610 may be positioned on the flap 608 as well as the second surface 604 of the liner 106 at a location adjacent to or near the first lateral edge 607. As shown in the embodiment of FIG. 5A, two frame coupling assemblies 606 are on a left edge of the liner 106 and configured to couple with the first lateral frame 400. Two frame coupling assemblies 606 are positioned on a rear edge of the liner 106 and configured to couple with the rear frame 450. Two frame coupling assemblies are positioned on a right edge of the liner 106 and configured to couple with the second lateral frame 500.

The at least one flap 608 may be configured to couple the liner 106 to the middle cross member 402 of the first lateral frame assembly 400, the middle cross member 450 of the rear frame 450, and/or the middle cross member 502 of the second lateral frame assembly 500. The coupling feature 610 may allow the flap 608 to be circumferentially looped around the middle cross member 402, 450, 502 and the flap 608 then coupled to the second surface 604 of the liner 106 using the coupling feature 610.

A seat coupling assembly 626 may be positioned about the aperture 624 and configured to couple the liner 106 to the seat 102. The coupling assembly 626 may have at least one seat coupling feature 628 configured to couple the liner 106 to the seat 102. The coupling feature 628 may be a first portion of a snap, hook and loop material coupling system, or similar system and configured to couple with a liner coupling feature 720 on the seat 102. The first portion of the coupling feature 628 may be positioned on the first surface 602 of the liner 106.

A front edge 631 of the liner 106 may form fluid diverter feature 630 with first coupling member 632 and second coupling member 634. In some examples, the coupling members 632, 634 are hooks configured to couple the front edge 631 to the frame 108. The fluid diverter feature 630 may allow for water sprayed or collected near the front edge 631 to drain back into the toilet base 110 as opposed to dripping over the front edge 631 and outside of the assembly 100. In some examples, coupling member 632 is configured to couple with the first upper vertical member 422 of the first lateral frame assembly 450 at a location adjacent to or above the connector 580*a*. In some examples, coupling member 634 is configured to couple with the first upper vertical member 522 of the second lateral frame assembly 500 at a location at or above the connector 580*l*. The position of the coupling members 632, 634 controls an overall height of the front edge 631 in relation the ground.

FIGS. 6A-D are top isometric, bottom isometric, bottom plan, and partial cross-sectional views of the seat 102 of the shower assembly 100 of FIG. 1. The seat 102 has a main body 700 that may be generally rectangular shaped with a top surface 702 opposite a generally parallel bottom surface 704, and a front surface 706 opposite a generally parallel rear surface 708. Two side surfaces 710 connect the top and bottom surfaces 702, 704, with the side surfaces 710 being normal to the top and bottom surfaces 702, 704. In some examples, each side surface 710 may have an indentation 738, with a surface offset inwards towards a drain channel 712. The indentation 738 may be used to aid a user in gripping the seat 102. There may also be a similar indentation in the rear surface 708.

The front and rear surfaces 706, 708 connect the top and bottom surfaces 702, 704, with the front and rear surfaces 706, 708 being normal to the top and bottom surfaces and normal to the side surfaces 710. The drain channel 712 is positioned in between the two side surfaces 710 and also connects the top and bottom surfaces 702, 704. In some examples, the drain channel 712 bisects the front surface 706. The drain channel 712 may be partially shaped similar to the toilet bowl 103, with an oval or circular rear end 736 and a narrower front end 734 adjacent the front surface 706. The drain channel 712 may provide a discharge channel for water to drain into the toilet bowl 103. The position of the rear end 736 near the center of the main body 700 may allow a majority of water to drain through the drain channel 712 and into the toilet bowl 103 of the toilet base 110 when the seat 102 is positioned and or aligned with the toilet bowl 103.

Figure 6A:
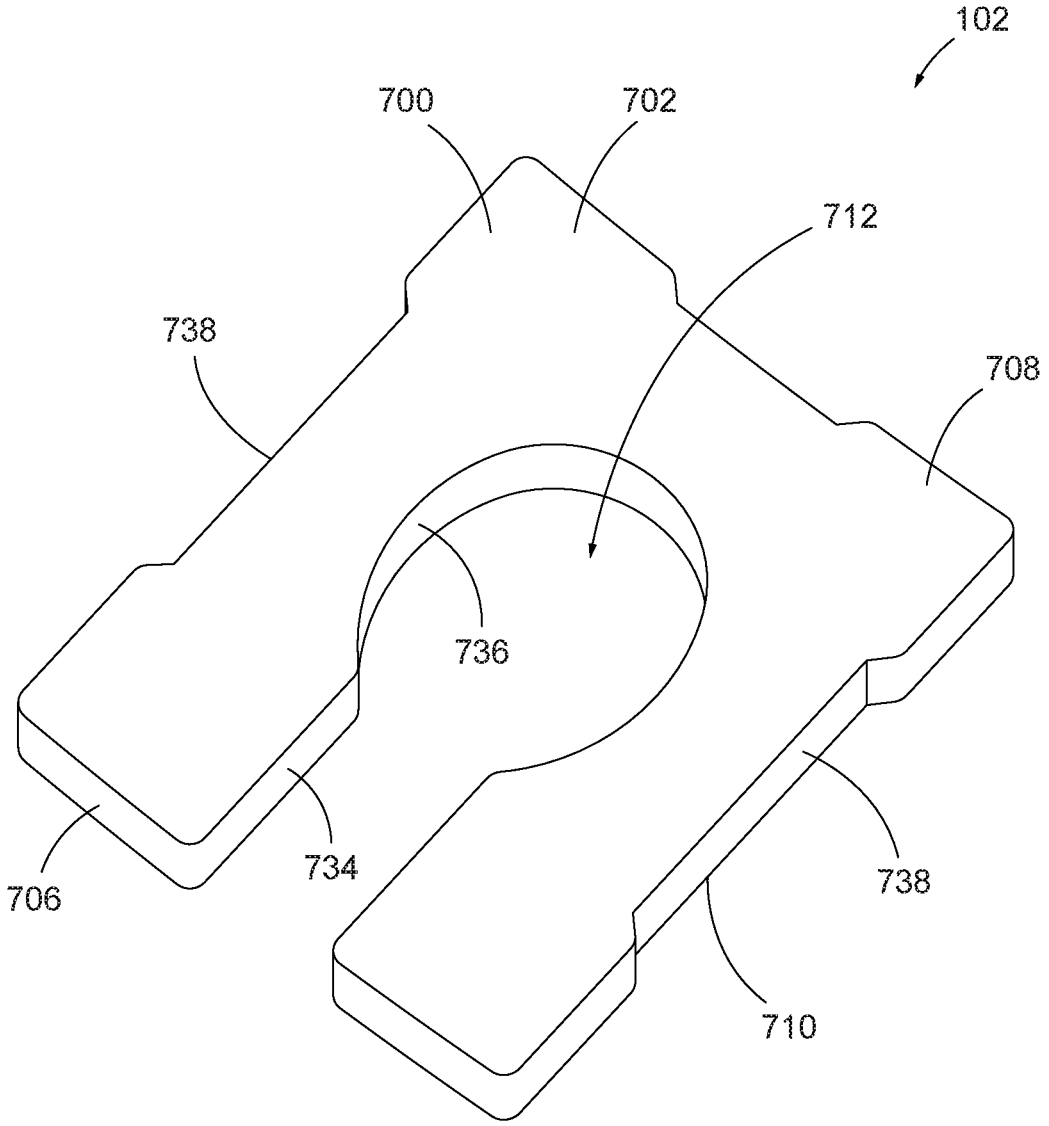
FIGS. 6A-D are top isometric, bottom isometric, bottom plan, and partial cross-sectional views of a seat of the shower assembly of FIG. 1.
Figure 6B:
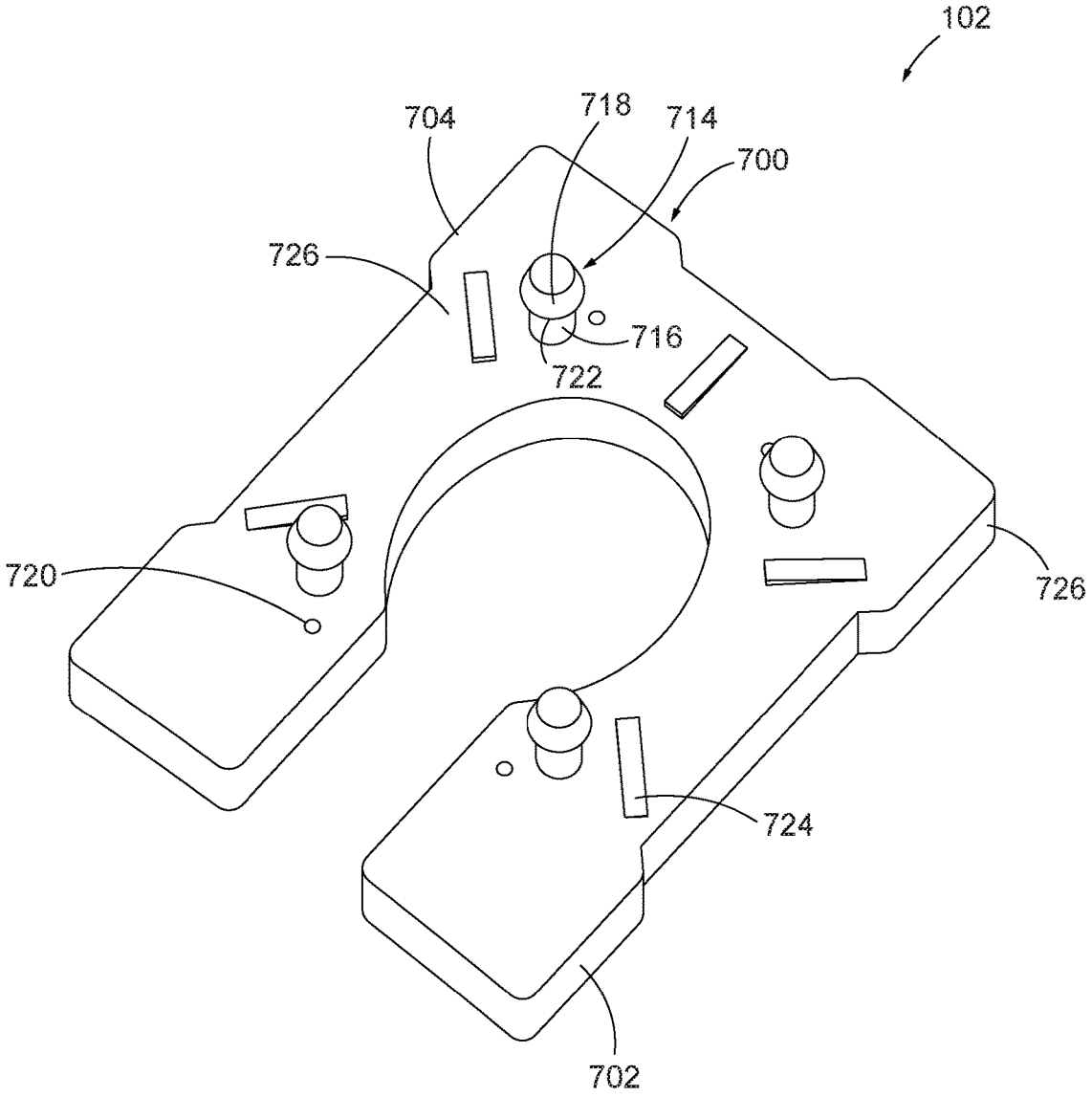

FIG. 6B is a bottom isometric view of the seat 102. At least one seat securement feature 714 is positioned adjacent the bottom surface 704 and positioned radially around the rear end 736 of the drain channel 712. In some examples, the seat securement feature 714 location may be similar to the inner rim shape of the toilet bowl 103 of the toilet base 110. In some examples, the seat securement feature 114 may have a protrusion 716, such as a post, extending away from the bottom surface 704, opposite the top surface 702. In some examples, the protrusion 716 may be generally cylindrical shaped (see FIG. 6D) with an outer surface 750 and a first end 740 positioned adjacent to the bottom surface 704. A second end 742 of the protrusion 716 may be bulbous or barbed shaped (e.g., as a frustum) as compared to the protrusion 716.

In some examples, the protrusion 716 may be a tube so that a fastener 732 may extend through it to couple or connect the protrusion 716 with the main body 700. The fastener 732 may have threads 748 to help couple it to the protrusion 716 and a base 728 of the main body 700. In other examples, the protrusion 716 may be threaded on the first end 740 to couple the protrusion 716 to the base 728.

Figure 6C:
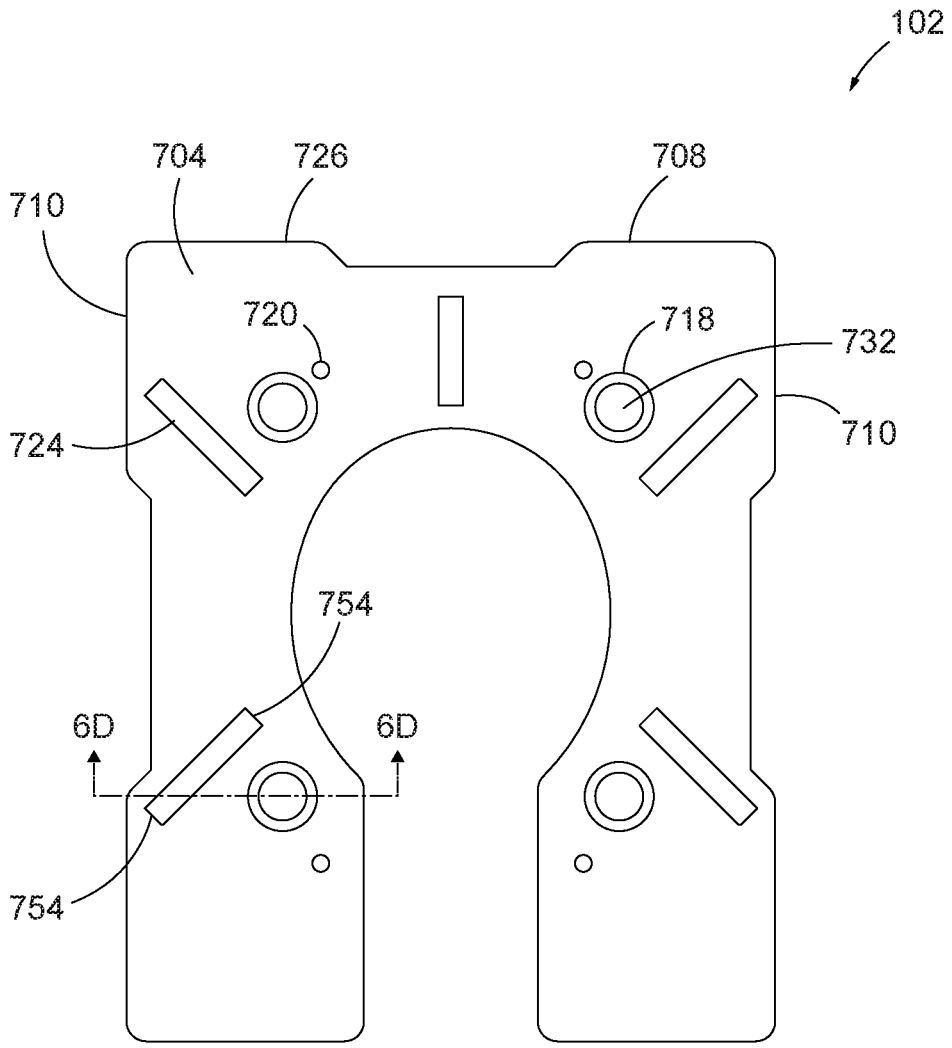
Figure 6D:
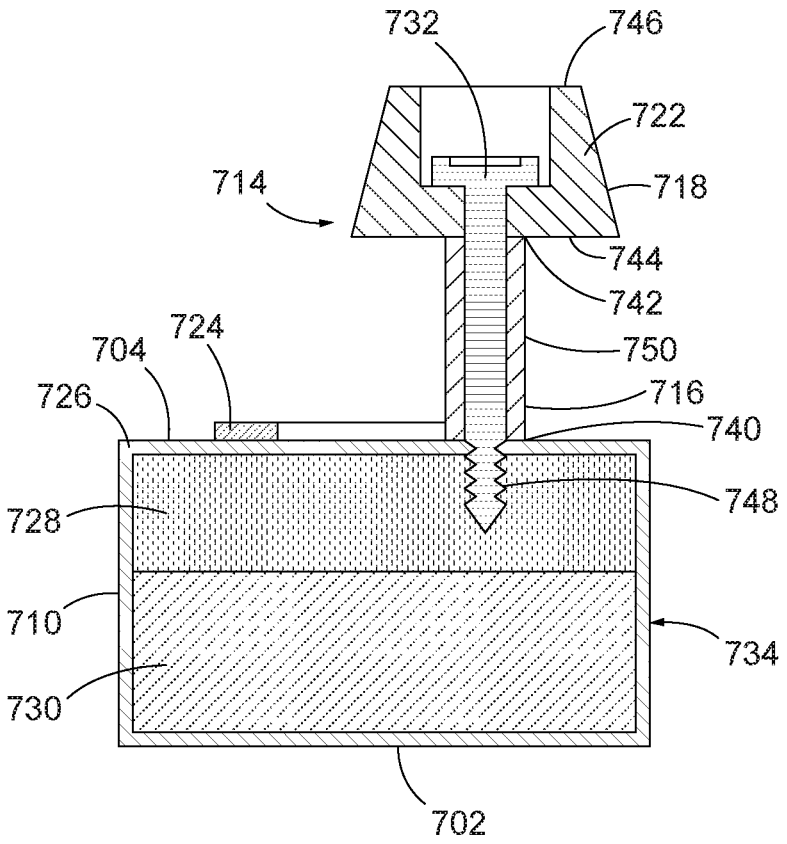

As shown in FIGS. 6B-6D, at least one bumper 724 may be positioned adjacent to the bottom surface 704. The bumper 724 may be generally elongate in shape (e.g., rectangular, oval, or round), and positioned radially about the oval shaped rear end 736 of the drain channel 712. The overall height of each bumper 724 is smaller than a height of the protrusion 716 of the seat securement feature 714. In some examples, a difference between height of the bumper 724 and the protrusion 716 may be the same as the general overall height of an inner rim of the toilet bowl 103 of the toilet base 110. Each bumper 724 may be positioned with a first end 752 positioned adjacent the drain channel 712, and a second end 754 opposite the first end 753 and position adjacent the side surfaces 710, the rear surface 708, or the front surface 706.

As shown in FIG. 6D, the seat 102 may have an internal portion made from a insulation or padding 730 and a rigid base 728. In some examples, a covering 726 may cover the top surface 702, the side surfaces 710, and at least portion of the bottom surface 704. The covering 726 may be made from material that is water proof or water resistant, as it will be exposed to water when the shower assembly 100 is used. In some examples, the covering 726 is made from a flexible rubber material. In some cases, a portion of the seat 102 is dipped in a rubber material during the manufacturing process to form the covering 726, and the seat securement feature 714 and bumpers 724 are connected to the seat 102 after. The bottom surface 104 may also be comprised of the rigid base 728. In some examples, the rigid base 728 is made from wood, composite, or similar materials that are suitable to support the weight of an adult sitting on the seat 102. In some examples, the rigid base 728 may be partially exposed and may be treated with a water proofing or water resistant coating or material that is suitable for preventing moisture absorption.

The seat 102 may also have a liner coupling feature 720 (see FIGS. 6B-C) positioned on the bottom surface 704. In some examples, the liner coupling feature 720 may form a portion of the seat coupling assembly 626 of the liner 106 (FIGS. 5A-B), and may be a second portion of a snap, hook and loop material coupling system, or similar system, and is configured to couple with the coupling feature 628 of the liner 106 to form the seat coupling assembly 626 that couple the liner 106 and the seat 102.

The bumpers 724 may be formed from rubber and coupled to the bottom surface 704 of the seat 102 (using fasteners) to allow the seat 102 to be elevated or raised above a supporting surface, such as the toilet bowl 103, with gap to allow for water to drain into toilet bowl 103. The bumpers 724 may also protect the bottom surface 704. When in use, the seat securement features 714 positioned in between the bumpers 724 temporarily align the seat 102 with existing rim of the toilet bowl 103. The shape of the seat securement features 714 allows the seat 102 to be frictionally and or forcibly engaged with the existing toilet rim of the toilet bowl 103. In some examples, the protrusion 716 compressively contacts an inner surface of the inner rim of the toilet bowl 103. In some examples, the bulbous second end 742 compressively contacts a bottom surface of the inner rim of the toilet bowl 103.

In some embodiments, it may be desirable to keep the elevated seat 102 coupled to the toilet base 110 even when the frame 108 is removed, as the padding 728 and the increased height due to the bumpers 724 and padding 728 may increase a user's comfort when sitting on the seat 102 and using the toilet base 110 for activities other than bathing.

Figure 7A:
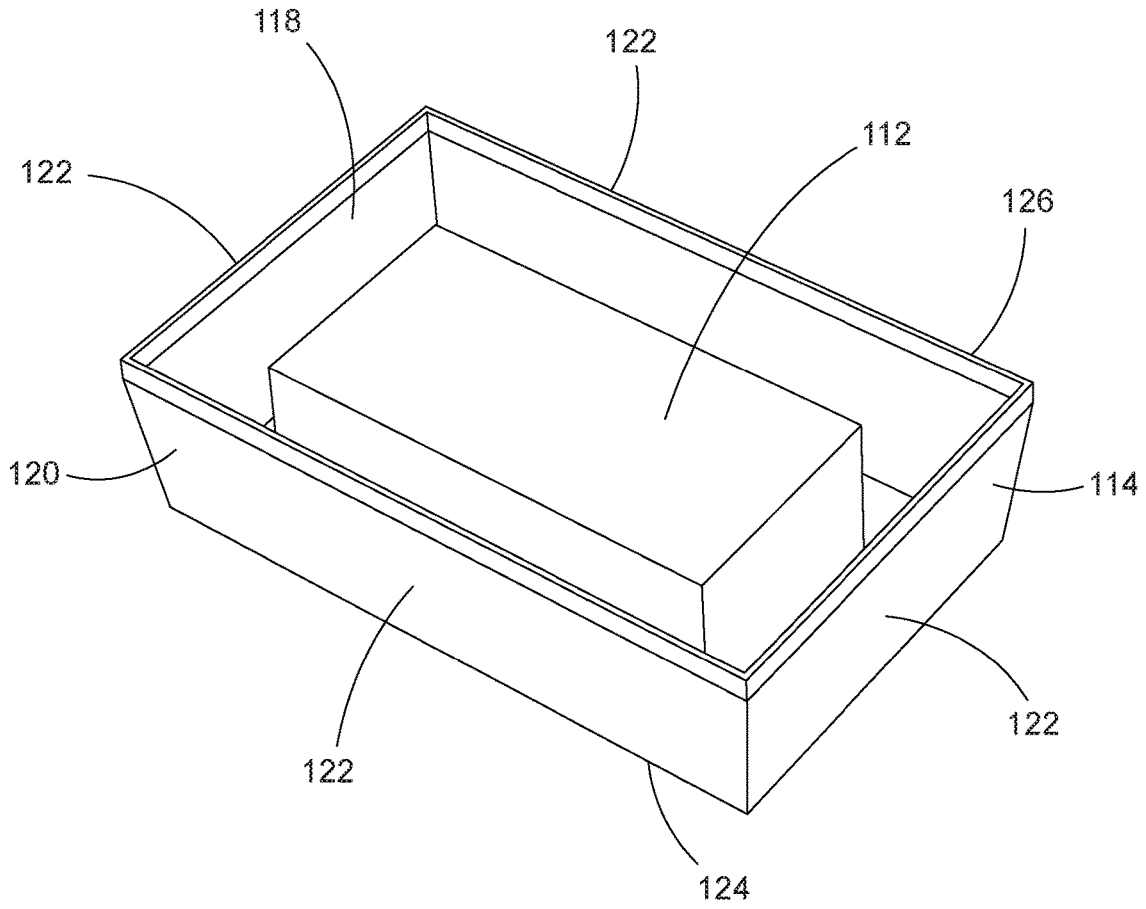
FIGS. 7A-B are top isometric view and exploded views of a pan and a footrest of the shower assembly of FIG. 1.
Figure 7B:
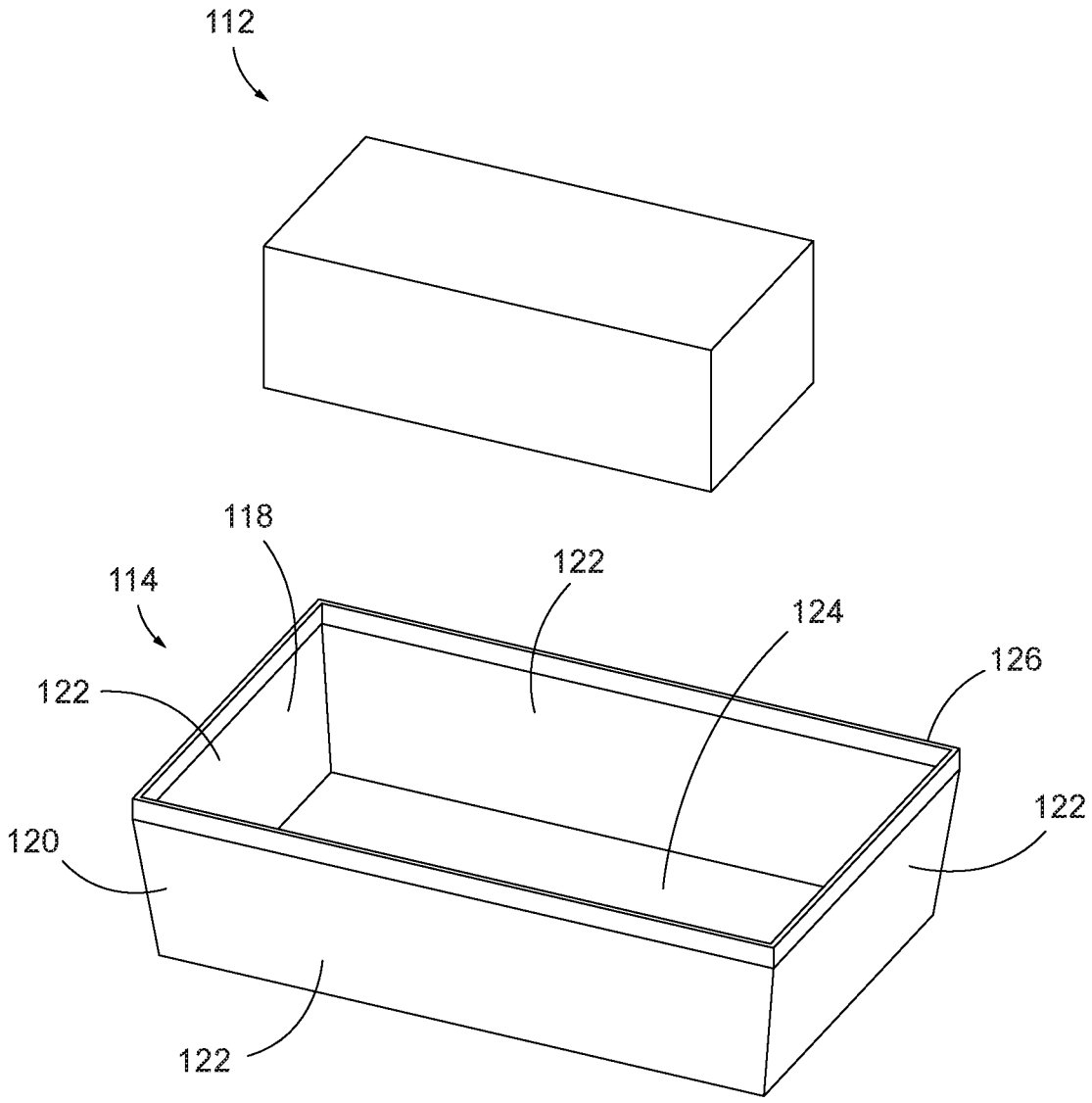

FIGS. 7A-B are isometric view and exploded views of the pan and footrest of the shower assembly 100 of FIG. 1. The footrest 112 may help elevate a user's legs to make the seated position on the seat 102 more comfortable when using the assembly 100. The pan 114 may have an interior surface 118, a top edge 126, an exterior surface 120, and a base 124. The pan 114 may have multiple walls 122 connected to the base 124 to form a bottom area of the pan 114. In some examples, the pan 114 has 4 walls 122 and may be rectangular shaped. In some examples, the pan 114 may have curved walls or features with more or less than 4 walls and be to be oval, triangular, circular, or oblong shaped. The top edge 126 of the pan 114 may form a border with an area that is larger than an area formed by the base 124 of the pan, such that the walls 122 taper in from the top edge 126 to the base 124. The pan 114 may be manufactured from plastic or any other appropriate material.

The footrest 112 is positioned in the pan 114. In some examples, the footrest 112 is shaped similarly to the pan 114, but may be generally smaller overall so that it may easily be positioned within the pan 114. In some examples, the footrest 112 is made from of a foam sponge, so that water that flows down a user's legs rather than into the toilet bowl 103 may be captured and contained within the footrest 112 and the pan 114. The footrest 112 may also be relatively stiff so that it may help support a user's leg when the assembly 100 is in use.

Figure 8:
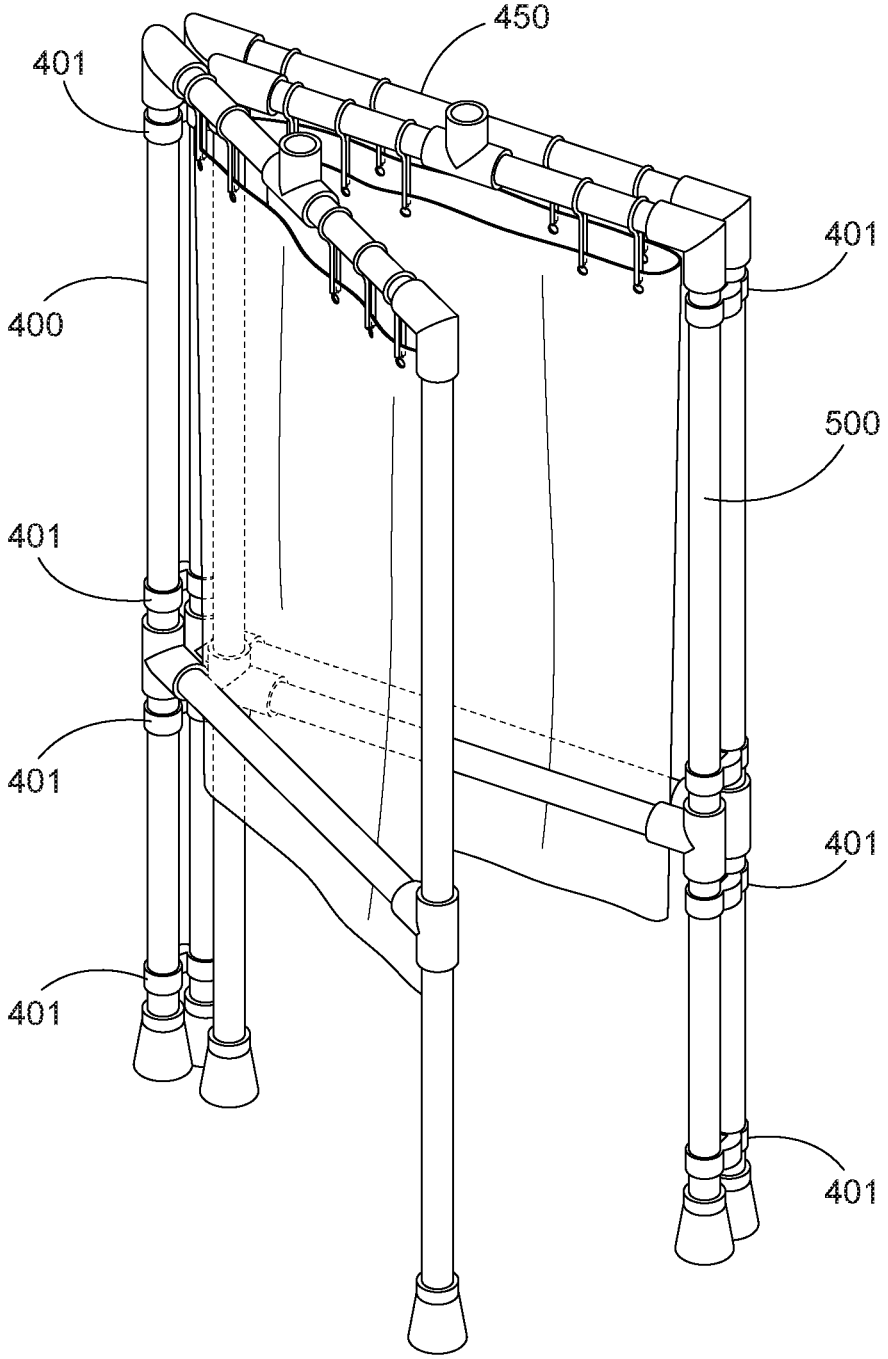
FIG. 8 is an isometric view of the frame and curtain of the shower assembly of FIG. 1 configured in a second position.

FIG. 8 is the base frame 108 of the shower assembly of FIG. 1 configured in a second position. As shown in FIG. 8, the base frame 108 may be manipulated into a second position, where the first and second lateral frames 400, 500 are positioned adjacent each other. In this second position, the frames 400, 450, 500 are generally parallel with each other. The position of the lateral frames 400, 500 with the rear frame 450 is adjustable as the flexible coupling members 401 flexibly couple the various frames 400, 450, 500 together but allows for the frames to be rotated with respect to each other.

Figure 9:
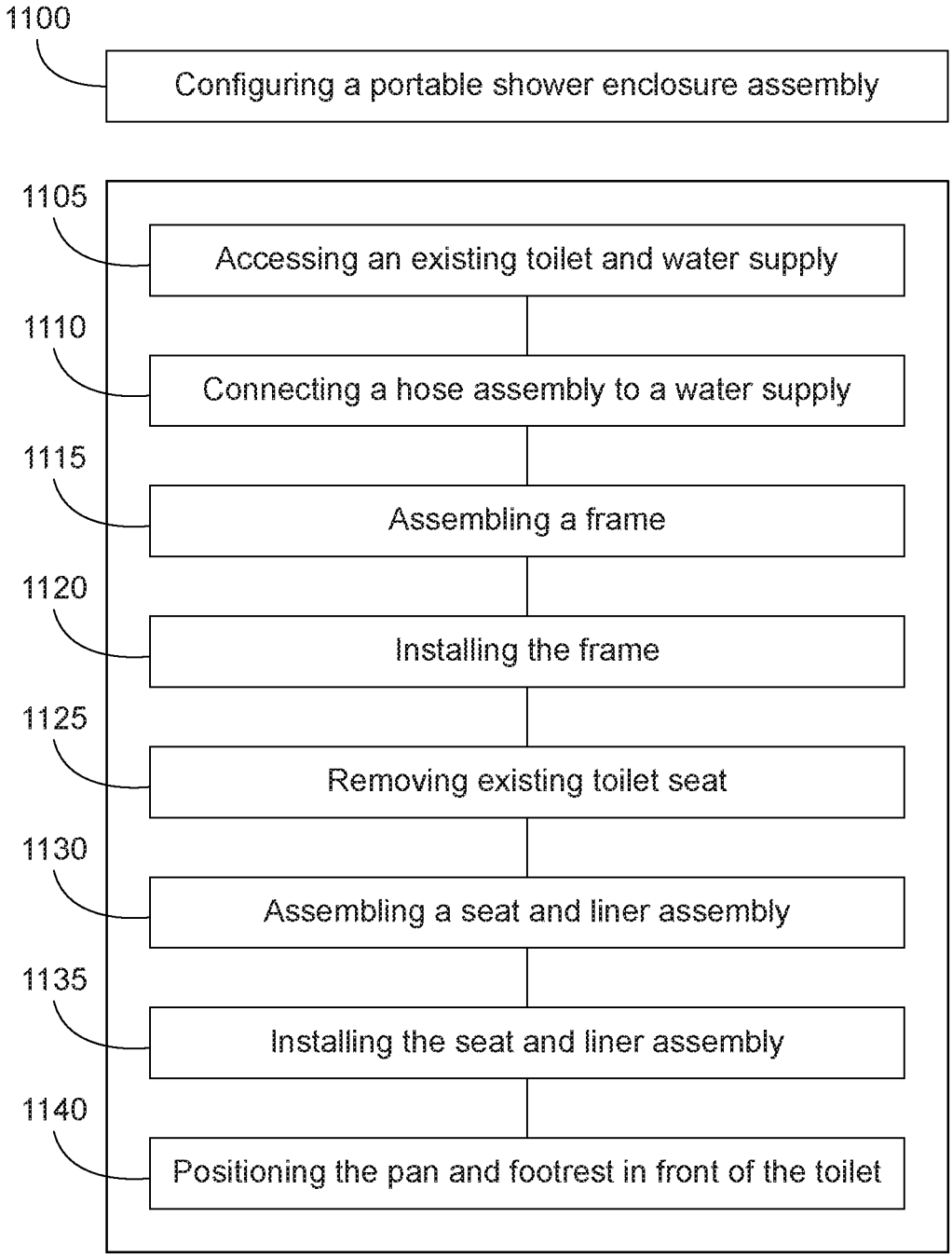
FIG. 9 is a method of configuring a portable shower enclosure assembly.

FIG. 9 shows a method 1100 of configuring a portable shower enclosure assembly similar to the assembly 100 as described with references to FIGS. 1-8. The method 1100 includes accessing an existing toilet and water supply, as indicated in Step 1105. The method 1100 may include connecting a hose assembly to a water supply (Step 1110). In some examples, the hose assembly of Step 1110 may be similar to the components of the hose assembly 116 of FIG. 1. The method 1100 may include assembling a frame (Step 1115). The frame of Step 1115 may be similar to the frame 108 of FIG. 1. The method 1100 may include installing the frame (Step 1120). The frame may be installed about the existing toilet. The method 1100 may include removing an existing toilet seat (Step 1125). In some examples, the existing toilet seat may already be removed. The method 1100 may include assembling a seat and liner assembly (Step 1130). The seat and liner assembly of step 1130 may be similar to the seat 102 and liner 106 of FIG. 1. The method 1100 may include coupling a coupling feature of a liner, such as coupling feature 628 of liner 106, to a coupling feature of a seat, such as coupling feature 720 of seat 102. The method 1100 may include installing the seat and liner assembly of Step 1130 (Step 1135). The method 1100 may include positioning the pan and footrest in front of the toilet (Step 1140). In some examples, the pan and footrest of Step 1140 are similar to the pan 114 and footrest 112 of FIG. 1.

The order of steps shown in FIG. 9 is not fixed, such that some steps may be performed before or after the performance of other steps. For example, Step 1125, removing the existing toilet seat may be performed at any time prior to Step 1135, installing the seat liner and assembly. In addition, Step 1110, connecting a hose assembly to a water supply, may be performed at any time prior to use of the assembly.

Figure 10:
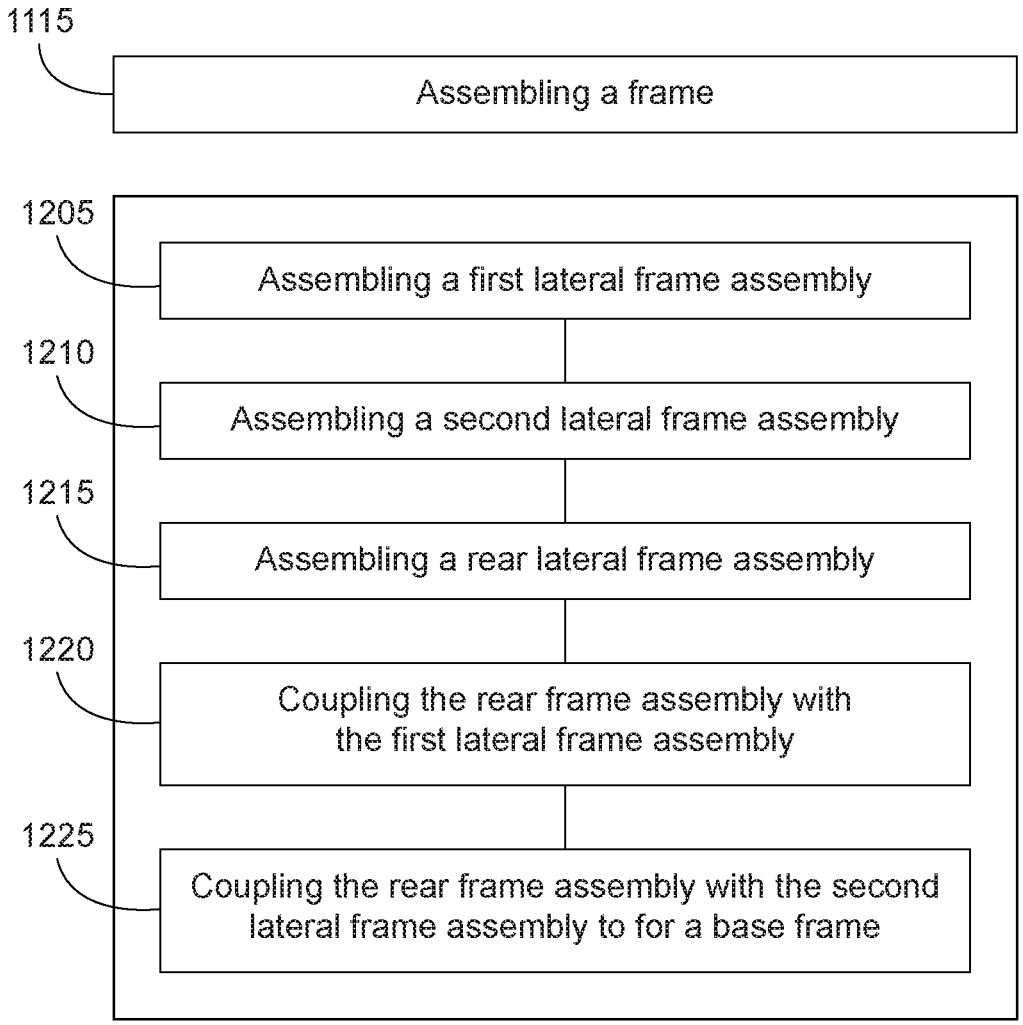
FIG. 10 is a method of assembling a frame for a portable shower enclosure assembly.

FIG. 10 shows details of a method of assembling a frame, such as step 1115 of FIG. 9. The method of assembling a frame may include assembling a first lateral frame assembly (Step 1205). The first lateral frame assembly of Step 1205 may be similar to the first lateral frame assembly 400 of FIG. 3. In some examples, the first lateral frame 400 has multiple components that may be assembled together to create the frame 400. Using multiple components may allow for the frame 400 to be more cost effectively produced, as shipping requirements may be more flexible when smaller components are shipped. It also may allow a consumer to customize the size and shape of the enclosure, depending on their wants and needs. For example, if the user is a taller person, they could customize the frame assembly by using longer vertical members, thereby making the overall frame taller, which could customizably accommodate the tall user. The method 1115 of assembling a frame may also include assembling a second lateral frame assembly (Step 1210). The second lateral frame assembly of Step 1210 may be similar to the second lateral frame assembly 500 of FIG. 3. The method 1115 of assembling a frame may also include assembling a rear frame assembly (Step 1215). The rear frame assembly of step 1215 may be similar to the rear frame assembly 450 of FIG. 3.

The method 1115 of assembling a frame may also include coupling the rear frame assembly with the first lateral frame assembly (Step 1220). The assemblies of Step 1220 may be coupled together with an element similar to frame coupling member 401, shown in FIG. 3. The use of the flexible coupling element allows the rear frame assembly and first lateral frame assembly to be flexibly coupled together, yet still positionable at various alignments with respect to each other. This flexibility may allow a user to customize the position of the frame assemblies with respect to the layout of the area in which they are going to use the portable shower enclosure. The frame location may be adjusted to account for a bathroom vanity, existing furniture, non-standard shaped toilet, etc.

The method 1115 of assembling a frame may also include coupling the rear frame assembly with the second lateral frame assembly (Step 1225). The second lateral frame assembly of Step 1225 may be similar to the second lateral frame assembly 500 of FIG. 3. Similar to Step 1220, the frames may be coupled together with a flexible coupling element that allows the frame to be positioned at various locations.

Figure 11:
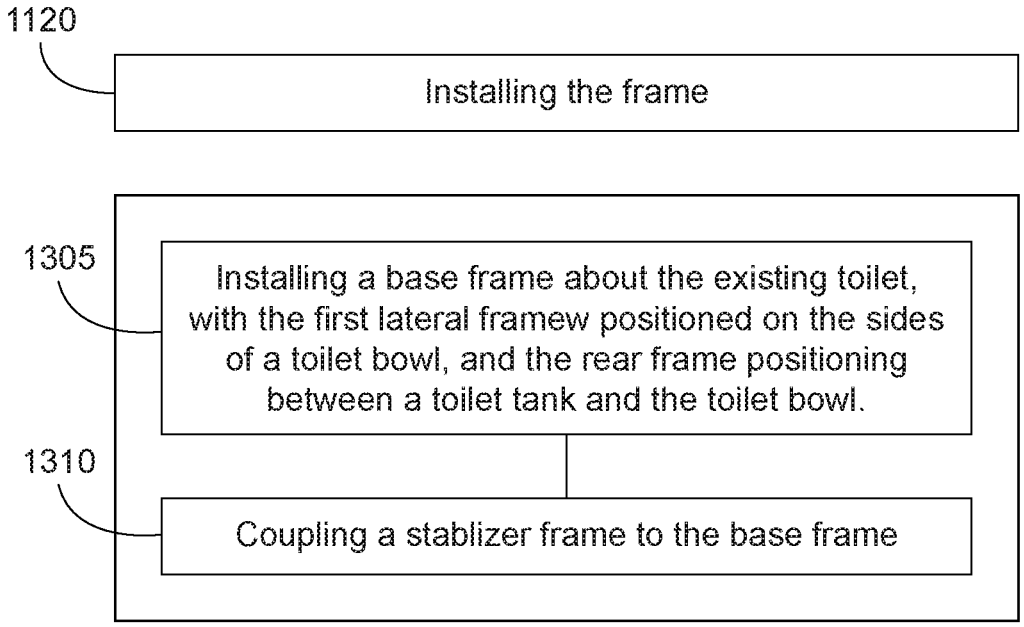
FIG. 11 is a method of installing a frame for a portable shower enclosure assembly.

FIG. 11 shows details of a method of installing a frame, such as step 1120 of FIG. 9. The method 1120 may include installing a base frame about the existing toilet, with the first and second lateral frame positioned on the sides of the toilet bowl, and the rear frame positioned between a toilet tank and the toilet bowl (Step 1305). The method 1120 may include coupling a stabilizer frame to the base frame (Step 1310). The stabilizer frame of Step 1310 may be similar to the stabilizer frame 111 of FIG. 3. The stabilizer frame of Step 1310 may be coupled to the base frame with connectors similar to connectors 580*m*, 580*n* of FIG. 4.

Figure 12:
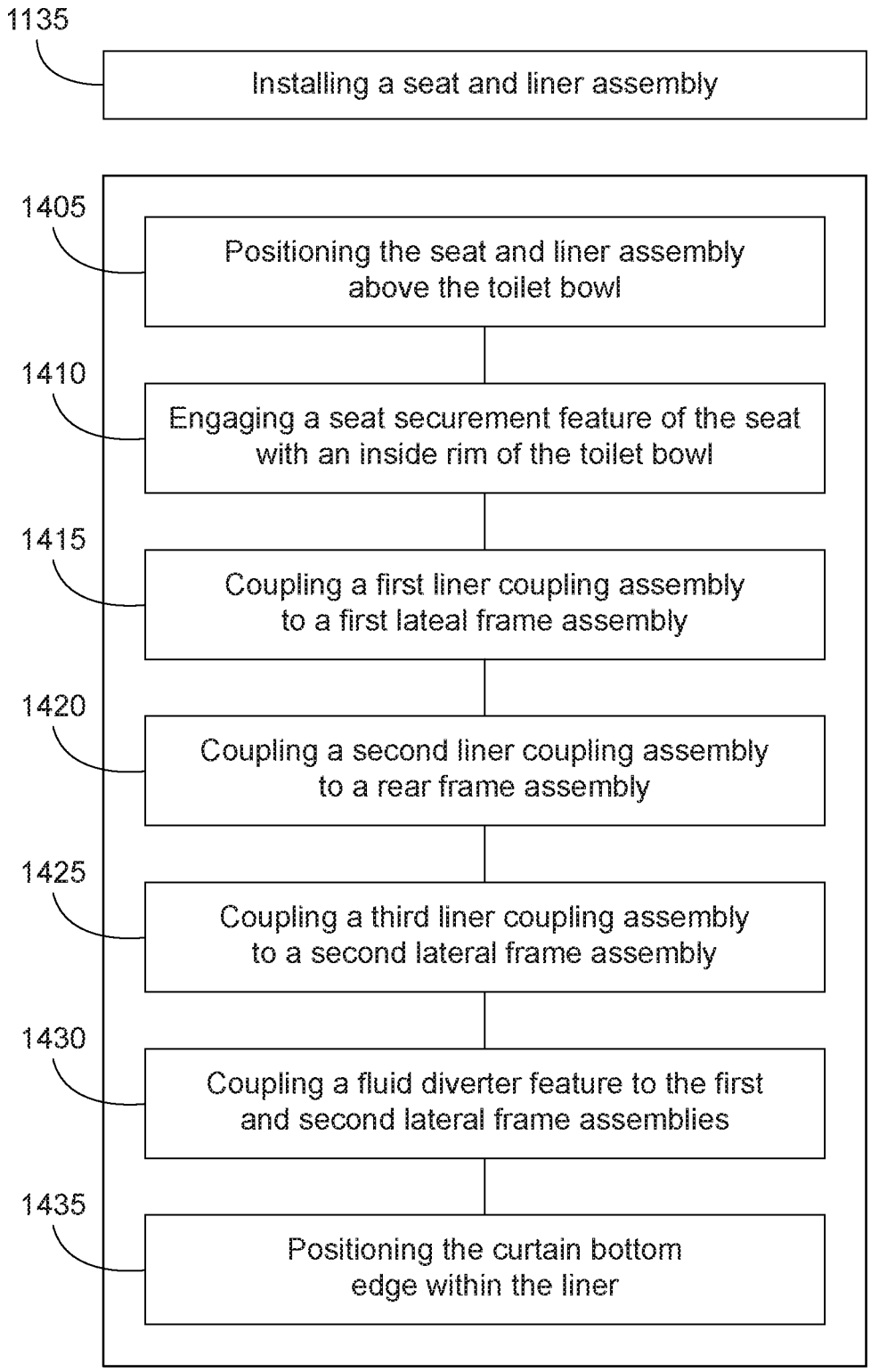
FIG. 12 is a method of installing a seat and liner assembly for a portable shower enclosure assembly.

FIG. 12 shows details of a method of installing the seat and liner assembly, such as Step 1135 of FIG. 9. The method 1135 may include positioning the seat and liner assembly above the toilet bowl (Step 1405). The seat is elevated from the toilet bowl by way of bumpers, similar to bumpers 724 of FIGS. 6B-6D. The method 1135 may include engaging a seat securement feature of the seat with an inside rim of the toilet bowl (Step 1410). The seat securement feature of step 1410 may be similar to the seat securement feature 714 of FIG. 6B-D. The securement feature 714 may be positioned such that when the seat 102 is initially pressed down onto the toilet bowl 103, the seat securement feature 714 flexes inward towards the drain channel 712. The flexing may be caused by the bulbous or barbed second end 742 contacting the inner rim of the toilet bowl 103, and being forced inward towards the drain channel 712. As the second end 742 is pushed and flexed inward by the rim, the seat 102 may be pushed further downwards towards the toilet bowl 103. Once the seat 102 is pushed close enough to the toilet bowl 103, the second end 742 will slide beneath the rim and contact an underside of the toilet bowl rim 103, while the main body of the 716 protrusion will contact the inner rim of the toilet bowl 103. The contact of both the second end 742 and the main body of the protrusion 716 to the toilet bowl 103 may help secure and temporarily couple the seat 102 onto the toilet bowl 103.

The method 1135 may include coupling a first liner coupling assembly to a first lateral frame assembly (Step 1415). The first liner coupling assembly of Step 1415 may be similar to the coupling assembly 606 of FIGS. 5A-B. The first lateral frame assembly of step 1415 may be similar to the first lateral frame assembly 400 of FIG. 3. In some embodiments, the flap 608 of the liner 106 is extended away from the first lateral edge 607 and from the central region 603 and wrapped around the middle cross member 402 of the first lateral frame assembly 400. The coupling feature 610 on the underside of the flap 608 and the second surface 604 is then engaged, securing the flap 608 about the middle cross member 402 to an area of the second surface 604 of the liner 106 near the first lateral edge 607 or on the underside of the flap 608. In some embodiments, the coupling feature 610 is a fabric hook and loop closure, or a snap.

The method 1135 may include coupling a rear coupling assembly to a rear frame assembly (Step 1420). The rear coupling assembly of step 1420 may be similar to the coupling assembly 606 of FIGS. 5A-B. The first lateral frame assembly of step 1415 may be similar to the rear frame assembly 450 of FIG. 3. The method of Step 1420 may be similar to the Step 1415.

The method 1135 may include coupling a third liner coupling assembly to a second lateral frame assembly (Step 1425). The third liner coupling assembly of step 1425 may be similar to the frame coupling assembly 606 of FIGS. 5A-B. The second lateral frame of step 1425 may be similar to the second lateral frame assembly 500 of FIG. 3. The method of Step 1425 may be similar to Steps 1415 and 1420.

The method 1135 may include coupling a fluid diverter feature to the first and second lateral frame assemblies (Step 1430). The fluid diverter feature of Step 1430 may be similar to the fluid diverter feature 630 of FIGS. 5A-5B. In some examples, the first coupling member 632 is an elastic hook or loop that is coupled to the first upper vertical member 422 of the first lateral frame assembly 400. In some examples, the second coupling member 634 is an elastic hook or loop that is coupled to the first upper vertical member 522 of the second lateral frame 500. In some embodiments, the fluid diverter feature help keep any fluid that may flow onto the liner 106 from spilling out of the liner 106 and dripping down towards the user's legs or feet.

The method 1135 may include positioning a curtain bottom edge within the liner (Step 1435). The curtain of Step 1435 may be similar to the curtain 104 of FIG. 1. The positioning of a bottom edge of the curtain may help ensure that any fluid released from the hose assembly that sprays the curtain then drains onto the liner, as opposed to outside of the liner 106. Positioning the curtain bottom edge within the liner 106 may help create a seal between the curtain 104 and the liner 106.

Upon the completion of Step 1435, the shower assembly may be ready for use by a user. A user may turn on the water supply to allow fluid to travel through the hose assembly 116. The user may then sit down, with their buttocks on the top surface 702 of the seat 102, and rest their feet on the footrest 112 in the pan 114. The user may then begin to direct the water exiting the wand 121 towards various body parts to cleanse or rinse the body parts. The water that exits the wand 121 may be deflected by the shower curtain 104 and flow into the toilet base 110 between the liner 106 and the seat 102. Water may also be deflected onto the liner 106 and the seat 102. Potential water that travels down a user's legs may travel onto the footrest 112 and be absorbed, or be collected in the pan 114.

The shower assembly 100 may be useful to people with disabilities or who are recovering from injury or surgery that do not have shower or bathing facilities on the ground floor. For example, for people with disabilities or are recovering from an injury or surgery, even simple tasks that were formerly easy to accomplish can seem monumental. Even attending to personal hygiene, such as toileting and bathing may be beyond the patient's physical capabilities.

Potential users of the shower assembly 100 may be people with disabilities, injuries, or caregivers taking care of others. One feature of the shower assembly 100 may be that it allows a user access to a portable bathing facility rather than going through the costly expense of adding a bathing facility to an accessible area of their home or current residence. Another feature may be that the shower assembly 100 may be easily produced, such that the manufacturing costs are fairly low, and the shower assembly 100 should be accessible to the user at a relatively low cost. Another feature may be that an open bathing unit, such as the shower assembly 100, facilitates cleaning a patient more efficiently (if a care giver is assisting in the bathing process) as the care giver may easily move around the shower assembly 100 since it does not have a large footprint. Another feature may be that the shower assembly 100 may also increase safety as slips and falls may be avoided since the patient would not have to be lifted or shifted around as much compared to bathing in a standard bathtub. Another feature may be that the fluid flowing into the shower assembly 100 from the adjacent water source drains efficiently and neatly into the toilet bowl 103 for less mess and cleanup. Another feature may be that the collapsible design of the frame 108 makes it easy to store in small spaces. Another feature may be that the drain channel 712 allows a user or caregiver bathing a user easy access to clean a patient's bottom without having to raise the user from the seat 102. This may reduce lifting and strain on the caregiver and avoid injuries from the patient slipping from the caregiver's grasp or fall-related injuries from losing balance while washing. Another feature may be that the shower assembly may be easy to clean, since the curtain 104, liner 106, and seat 102 may be easily rinsed off using the hose assembly 116 once the user is finishing bathing.

It should be noted that although the various examples discussed herein have been discussed with respect to shower enclosures, the devices and techniques may be applied in a variety of applications, such as, but not limited to, recreational vehicles, camping trailers, hospitals, pet care, and day care facilities.

All directional references (e.g., upper, lower, upward, downward, left, right, leftward, rightward, top, bottom, above, below, vertical, horizontal, clockwise, and counterclockwise) are only used for identification purposes to aid the reader's understanding of the examples of the disclosure, and do not create limitations, particularly as to the position, orientation, or use of the disclosure unless specifically set forth in the claims. Joinder references (e.g., attached, coupled, connected, joined and the like) are to be construed broadly and may include intermediate members between the connection of elements and relative movement between elements. As such, joinder references do not necessarily infer that two elements are directly connected and in fixed relation to each other.

In some instances, components are described by reference to "ends" having a particular characteristic and/or being connected with another part. However, those skilled in the art will recognize that the present disclosure is not limited to components which terminate immediately beyond their point of connection with other parts. Thus the term "end" should be broadly interpreted, in a manner that includes areas adjacent rearward, forward of or otherwise near the terminus of a particular element, link, component, part, member, or the like.

In methodologies directly or indirectly set forth herein, various steps and operations are described in one possible order of operation but those skilled in the art will recognize the steps and operation may be rearranged, replaced or eliminated without necessarily departing from the spirit and scope of the present disclosure. It is intended that all matter contained in the above description or shown in the accompanying drawings shall be interpreted as illustrative only and not limiting. Changes in detail or structure may be made without departing from the spirit of the disclosure as defined in the appended claims.

What is claimed is:

1. A portable shower enclosure comprising a base frame having three vertical sides formed by a rear frame, a first lateral frame that pivotably couples with a first lateral side of the rear frame, and a second lateral frame that pivotably couples with second lateral side of the rear frame;

a seat having a top surface opposite a bottom surface and defining a drain aperture therethrough;

one or more bumpers that extend from the bottom surface and are configured to interface with a rim of a toilet bowl and elevate the seat above the rim of the toilet bowl; and a waterproof liner defining an aperture therein sized and configured to be positioned over the toilet bowl under the seat and having a frame coupling assembly configured to adjustably couple the waterproof liner to the first lateral frame, the second lateral frame, and the rear frame.

2. The portable shower enclosure of claim 1, wherein each of the first lateral frame and the second lateral frame includes an upper cross member; and the portable shower enclosure further comprises a stabilizer frame member coupled to the upper cross member of the first lateral frame and to the upper cross member of the second lateral frame.

3. The portable shower enclosure of claim 1 further comprising one or more seat securement features that extend from the bottom surface away from the top surface, the seat securement feature including a protrusion having a bulbous end, wherein the seat securement feature is configured to temporarily secure the seat to a toilet base.

4. The portable shower enclosure of claim 3, wherein the protrusion of the seat securement feature is configured to contact an inner wall of the rim of the toilet bowl, and the bulbous end of the seat securement feature is configured to contact an underside of the rim of the toilet bowl.

5. The portable shower enclosure of claim 4, wherein the protrusion compressively contacts the inner wall of the rim.

6. The portable shower enclosure of claim 4, wherein the bulbous second end compressively contacts the underside of the rim.

7. The portable shower enclosure of claim 4, wherein a length of the protrusion of the seat securement feature is configured to be congruent with a thickness of the bumpers plus a thickness of the rim of the toilet bowl.

8. The portable shower enclosure of claim 1, wherein the drain aperture in the seat defines a drain channel from a front edge of the seat to a middle of the seat.

9. The portable shower enclosure of claim 8, wherein the bumpers are elongate and extend radially outward from a rear portion of the drain channel.

10. The portable shower enclosure of claim 1, wherein the first lateral frame, the second lateral frame, and the rear frame each further include a lower horizontal cross member; and the frame coupling assembly of the waterproof liner comprises a plurality of flaps configured to loop around the lower horizontal cross members at a plurality of locations and thereby secure the waterproof liner to the base frame.

11. The portable shower enclosure of claim 1 further comprising a diverter bar attached to and extending along a front edge of the waterproof liner and which defines an attachment feature at each lateral end configured to connect with a front, vertical corner post of each of the first lateral frame and the second lateral frame.

12. The portable shower enclosure of claim 1 further comprising a waterproof curtain moveably attached to the upper cross members of each of the first lateral frame and the second lateral frame and further to an upper cross member of the rear frame.

13. The portable shower enclosure of claim 12, wherein
the seat further comprises a liner coupling feature on the bottom surface thereof; and
the waterproof liner further comprises a seat coupling feature configured to releasably connect with the liner coupling feature of the seat.

14. A portable shower enclosure kit comprising
a base frame having three vertical sides formed by a rear frame, a first lateral frame that pivotably couples with a first lateral side of the rear frame, and a second lateral frame that pivotably couples with second lateral side of the rear frame;
a seat having
a top surface opposite a bottom surface and defining a drain aperture therethrough;
one or more bumpers that extend from the bottom surface and are configured to interface with a rim of the toilet bowl and elevate the seat above the rim of the toilet bowl;
a waterproof liner defining an aperture therein sized configured to be positioned over the toilet bowl under the seat and having a frame coupling assembly configured to adjustably couple the waterproof liner to the first lateral frame, the second lateral frame, and the rear frame; and
a waterproof curtain moveably attached to each of the first lateral frame, the second lateral frame, and the rear frame.

15. The portable shower enclosure kit of claim 14 further comprising a pan.

16. The portable shower enclosure kit of claim 15 further comprising a footrest in the form of a foam or sponge block positioned within the pan.

17. The portable shower enclosure kit of claim 14 further comprising a handheld showerhead and hose.

18. The portable shower enclosure kit of claim 17 further comprising a hose connector configured for attachment to a sink faucet.

19. A method of configuring a portable shower enclosure comprising
accessing an existing toilet and water supply;
removing an existing toilet seat from the toilet;
assembling a frame;
installing the frame about the toilet;
assembling a seat and liner together;
installing the seat and liner upon a rim of a toilet bowl of the toilet;
attaching the liner to the frame; and
attaching a curtain to the frame around the toilet.

20. The method of claim 19, wherein the step of installing the frame further comprises
assembling a first lateral frame, a second lateral frame, and a rear frame;
pivotably coupling each of the first lateral frame and the second lateral frame to lateral sides of the rear frame;
positioning the rear frame between a toilet tank and the toilet bowl;
positioning the first lateral frame and the second lateral frame on lateral sides of the toilet bowl; and
coupling a stabilizer frame between the first lateral frame and the second lateral frame.

21. The method of claim 20, wherein the step of installing the seat and liner further comprises
engaging a seat securement feature of the seat with an inside rim of the toilet bowl;
attaching a first liner coupler of the liner to the first lateral frame;
attaching a second liner coupler of the liner to the second lateral frame;
attaching a third liner coupler of the liner to the rear frame;
attaching a fluid diverter feature along a front edge of the liner to the first and second lateral assemblies; and
positioning a bottom edge of the curtain within the liner.

* * * * *